US008932071B2

(12) United States Patent
Venema et al.

(10) Patent No.: US 8,932,071 B2
(45) Date of Patent: Jan. 13, 2015

(54) ATTACHABLE PLUG-TYPE CONNECTOR

(75) Inventors: Guido Venema, Detmold (DE); Bernd Behling, Steinheim (DE); Jens Andresen, Blomberg (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 69 days.

(21) Appl. No.: 13/805,584

(22) PCT Filed: Jun. 14, 2011

(86) PCT No.: PCT/EP2011/059847
§ 371 (c)(1),
(2), (4) Date: Dec. 19, 2012

(87) PCT Pub. No.: WO2011/157709
PCT Pub. Date: Dec. 22, 2011

(65) Prior Publication Data

US 2013/0109220 A1 May 2, 2013

(30) Foreign Application Priority Data

Jun. 14, 2010 (DE) ..... 10 2010 017 361

(51) Int. Cl.
*H01R 13/64* (2006.01)
*H01R 13/62* (2006.01)
*H01R 13/74* (2006.01)

(52) U.S. Cl.
CPC ..... *H01R 13/62* (2013.01); *H01R 13/743* (2013.01)
USPC ..... 439/248; 439/557

(58) Field of Classification Search
CPC .. H01R 13/6315; H01R 13/74; H01R 13/743; H01R 13/745; H01R 23/7063; H01R 23/5057; H01R 33/46
USPC ..... 439/247, 248, 545, 546, 549, 552–558, 439/570, 571
See application file for complete search history.

(56) References Cited

U.S. PATENT DOCUMENTS 3,432,802 A * 3/1969 Ritchie ..... 439/465
3,753,212 A * 8/1973 Yamada et al. ..... 439/358

(Continued)

FOREIGN PATENT DOCUMENTS

CN 1998114 A 7/2007
DE 69510072 9/1996

(Continued)

OTHER PUBLICATIONS

International Search Report issued in PCT/EP2011/059847 on Sep. 26, 2011.

(Continued)

*Primary Examiner* — Thanh Tam Le
(74) *Attorney, Agent, or Firm* — DLA Piper LLP (US)

(57) ABSTRACT

Aspects herein relate to an attachable plug-type connector for attachment to a plate-like component part, in particular a device or housing wall, with an attachable housing and a contact carrier. In one implementation, the contact carrier may be arranged in the attachable housing and has at least one female or male contact in a plug-in section of the attachable plug-type connector and at least one connection element. Further, the attachable housing may have at least one plug-in stop and may include an attachable arrangement with a plate-like component part and an attachable plug-type connector.

15 Claims, 2 Drawing Sheets

(56) References Cited

U.S. PATENT DOCUMENTS

| | | | | | |
|---|---|---|---|---|---|
| 4,168,874 | A | * | 9/1979 | Weidler et al. | 439/557 |
| 4,820,180 | A | * | 4/1989 | Mosquera et al. | 439/248 |
| 4,836,804 | A | * | 6/1989 | London et al. | 439/598 |
| 5,211,585 | A | * | 5/1993 | Douty et al. | 439/680 |
| 5,249,982 | A | * | 10/1993 | Funck et al. | 439/556 |
| 5,514,000 | A | | 5/1996 | Krause et al. | |
| 5,525,074 | A | | 6/1996 | Tsuji et al. | |
| 5,575,673 | A | * | 11/1996 | Dahlem et al. | 439/248 |
| 6,017,233 | A | * | 1/2000 | Fry et al. | 439/248 |
| 6,860,759 | B2 | * | 3/2005 | Nakamura et al. | 439/557 |
| 7,597,587 | B1 | * | 10/2009 | Duesterhoeft | 439/545 |
| 7,789,701 | B2 | * | 9/2010 | Murr et al. | 439/552 |
| 2009/0098768 | A1 | | 4/2009 | Giefers | |
| 2009/0298332 | A1 | | 12/2009 | Murr | |

FOREIGN PATENT DOCUMENTS

| | | | |
|---|---|---|---|
| DE | 60205364 | | 4/2006 |
| EP | 0501393 | | 4/1996 |
| EP | 1391011 | | 8/2005 |
| EP | 1 655 813 | | 5/2006 |
| JP | 2002-170635 | A | 6/2002 |
| JP | 2003-338346 | | 11/2003 |
| JP | 2008-60041 | A | 3/2008 |
| JP | 2008-293677 | A | 12/2008 |

OTHER PUBLICATIONS

International Preliminary Report on Examination and Written Opinion issued in PCT/EP2011/059847 on Dec. 14, 2012.

English Language Abstract of EP 1 655 813 published May 10, 2006.

English Language Abstract and Translation of JP 2003-338346 published Nov. 28, 2003.

English Language Abstract of DE 60205364 published on Apr. 20, 1996.

English Language Abstract of DE 69510072 published Sep. 19, 1996.

Prosecution of Chinese counterpart application No. 201180020042.6, including Chinese First Office Action issued Jun. 30, 2014 (7pgs.) and Search Report dated Jun. 20, 2014, (2 pgs.) total 9 pgs.

* cited by examiner

ATTACHABLE PLUG-TYPE CONNECTOR

CROSS-REFERENCE TO RELATED APPLICATIONS

This application is a U.S. National Stage Application of International Application No. PCT/EP2011/059847 filed Jun. 14, 2011, published as WO2011/157709, and which claims priority from German Patent Application No. 10 2010 017 361.4 filed Jun. 14, 2010. The entirety of all of the above-listed Applications are incorporated herein by reference.

BACKGROUND

1. Field

The present invention relates to an attachable plug-type connector for attachment to a plate-like component part, in particular a device or housing wall, with an attachable housing and a contact carrier which is arranged in the attachable housing and has at least one female contact or at least one male contact in a plug-in section of the attachable plug-type connector and at least one connection element, which is electrically connected to the female connector or male connector in a connection section of the attachable plug-type connector.

2. Description of Related Information

An attachable plug-type connector of this kind is known, for example, for installing in the housings of electrical devices and systems. For this purpose, there are attachable plug-type connectors that are plugged from the outside in the opening of the housing wall (that is, with the plug-in section) and those that are plugged from the inside in the opening of the housing wall (that is, with the plug-in section). In its simplest form, the attachable plug-type connector consists of a only a single contact carrier or insert connector in an attachable housing. The attachable housing has a fastening device for releaseably fastening the attachable plug-type connector in an opening of the plate-like component part. In this configuration, the attachable housing is screwed directly to the device or housing wall, for example, by means of a threaded connection on both sides of the former. The attachable plug-type connector can be mounted either as a wall bushing without an attachable housing or in a subhousing. Standard insert connectors with female contacts or male contacts can be used in the attachable plug-type connector as well as in an associated mating connector, for example, a sleeve plug-type connector.

Modularly constructed attachable plug-type connectors with insert connector modules and end elements in the form of mounting flanges are also known. The insert connector modules may be strung together as desired, whereby the series created is closed off on both sides by the mounting flanges and integrated fastening devices.

Alternatively, there are also attachable plug-type connectors with a round cross-section in which pre-assembled wires are fed into the housing. Subsequently, a lock nut is threaded over the cables for purposes of locking in place the attachable plug-type connector being plugged in from the outside.

Given the conventional types of fasteners, such prior art attachable plug-type connectors, in particular pre-assembled attachable plug-type connectors, cannot be mounted very quickly to device or housing walls.

DETAILED DESCRIPTION

Figure 1:
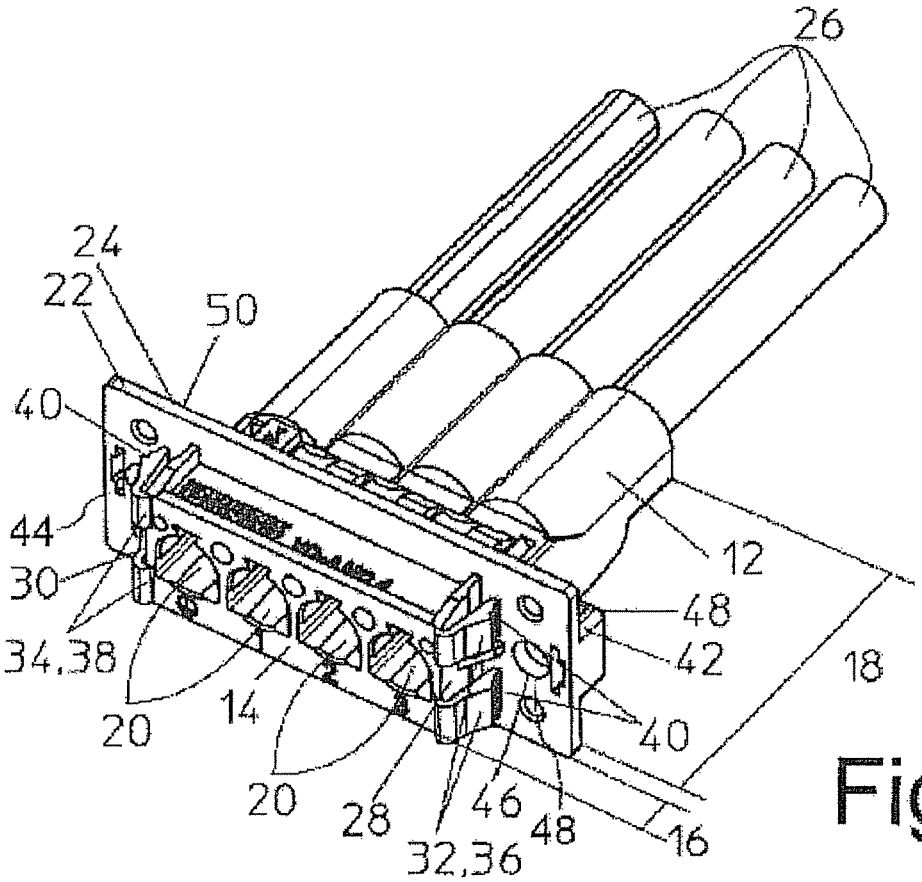
FIG. 1 is a perspective view of a preassembled attachable plug-type connector with wires connected thereto and FIG. 2 is a perspective view of the attachable plug-type connector of FIG. 1 affixed in an opening of a plate-like component part.

In the attachable plug-type connector of the present invention, it is provided that the attachable housing has at least one plug-in stop and at least one latching means for fixing the attachable plug-type connector to an edge which delimits an opening of the plate-like component part, said attachable plug-type connector being latched from behind on said edge, wherein this fixing of the attachable plug-type connector on the component part occurs automatically when the plug-in section is plugged into the opening as far as the plug-in stop by means of a spring device on the latching means. This design of the attachable plug-type connector as an attachable plug-type connector for simple clip mounting enables the connector to be easily and conveniently inserted from the inside into a housing or wall of a device or a system and lock automatically in place when plugged in as far as the stop. Thus, the present attachable plug-type connector is a clip-on attachable plug-type connector. Configuring the attachment of the attachable plug-type connector in the opening of the plate-like structure as a rear-locking attachment by means of a spring-loaded latching means makes it readily possible to attach the attachable plug-type connector even for more inaccessible areas or where a complicated routing of already pre-assembled wires is involved.

According to an advantageous embodiment of the invention, it is provided that the spring device is preloaded or can be preloaded when passing through the opening from the edge that delimits said opening. Once the plug-in stop is reached, the spring device releases, thereby bringing a latch structure into a position in which the latter, together with the plug-in stop, forms a positive connection with the plate-like component part in the region of the edge which delimits the opening.

According to a further advantageous embodiment of the invention, it is provided that the latching means has to have passed completely through in order to reach the fixed position of the attachable plug-type connector. If the attachable plug-type connector is affixed to the plate-like component part, for example, attachment of an attachable plug-type connector with pre-assembled wiring to a housing wall of an electrical device, the attachable housing is plugged in from the inside out relative to the housing wall of the device. A latching means that is passed completely through the opening is disposed completely outside the device when the attachable plug-type connector is in the fixed position. The latching means can be easily manipulated from the outside when the attachable plug-type connector is again detached from the opening.

In particular, it is provided that the spring device is designed as a spring arm arranged on the housing body of the attachable housing, at the free end of which at least one latch surface is formed for latching the plate-like component part from behind in the region of the edge that delimits the opening. In this configuration, the spring element is preferably designed so that the free end thereof is pressed in the direction of the housing body when passing through the opening. The latching surface is disposed at said free end. Once the latching means has fully passed through the opening, the spring arm is then able to release once again so that the latching means locks the plate-like component part from behind in the region of the edge that delimits the opening.

In general, the at least one connection element can be a connection element for any type of electrical connection, for example, a screw connection, solder connection, etc. According to an advantageous embodiment of the invention it is provided, however, that the at least one connection element is in the form of a crimp contact element. The connection element of the attachable plug-type connector designed as a crimp contact element guarantees all the advantages of crimp technology, such as, for example, the possibility of automatic preassembly.

According to an advantageous embodiment of the invention, an extension with an end face is provided on each opposite side of the attachable housing which comes to rest opposite an associated surface region of the plate-like component part when the attachable plug-type connector is in the fixed position. In particular, the end faces of the extensions define the plug-in stop, or at least a part of the plug-in stop, of the attachable plug-type connector.

In particular, it is provided that each of the extensions accommodates at least one press-in nut. This press-in nut serves in particular to form a releasable screw connection with a locating screw of a plug connector-counterpart that can be plugged onto the attachable plug-type connector, said screw extending through a hole in the plate-like component part. The plug connector-counterpart is in particular a sleeve plug-type connector, which is comprised, for example, of an insert connector, a sleeve housing and the aforesaid locating screws. The locating screws are generally arranged on the flanks of the plug-connector-counterpart. By using press-in nuts it is possible to design at least the attachable housing as a plastic part, in particular a single-piece plastic part. To press in the press-in nut, each extension is designed with a correspondingly dimensioned recess for receiving the nut.

Alternatively, the at least one press-in nut is provided in the body of the attachable housing.

It is advantageously provided that the press-in nut is in the form of a square nut. A square nut is especially easy to press into a corresponding recess.

According to a further advantageous embodiment of the invention it is provided that the female contacts or male contacts in the contact carrier are arranged in at least one row. Thus, it is preferable if the attachable plug-type connector is an attachable plug-type connector with a square plug face. In this configuration, the locating screws and the press-in nuts are preferably arranged on the sides of the attachable plug-type connector or of the plug connector-counterpart, that is, on the short sides (flanks) thereof.

Preferably, at least one pair of latching means is arranged on opposite sides of the attachable housing. Preferably, said latching means are also arranged on the short sides, that is, on the flanks of the attachable plug-type connector with the square plug face. Since the corresponding nuts are arranged in lateral extensions, said extensions are arranged in particular radially outside of the latching means which are arranged in the same region. This provides for a compact attachable plug-type connector.

In general, the attachable housing may consist of an electrically conductive material or of an electrically insulating material. In particular, it is provided that the attachable housing consist of an electrically insulating material (insulator). It is preferable if the attachable housing is in the form of a plastic housing. Said plastic is, for example, polybutylene terephthalate (PBT) or polyamide (PA). It is especially preferred if the attachable housing is an injection-molded housing.

Further, it is advantageously provided that the attachable housing and the contact carrier are designed together as a single piece. In this embodiment, the attachable housing and the contact carrier are made of an insulating material.

According to the invention, it is provided that the plug-in stop is designed as a circumferential rim. In particular, the rim is a rim for holding a seal which seals the attachable housing in its fixed position against the plate-like component part about the entire circumference of the opening. The circumferential rim can be designed together with the attachable housing as a single piece, or as a separate component part of the attachable plug-type connector, which, for example, is pressed via the end face of the extensions with the seal against the surface of the plate-like component part.

The present invention also relates to a corresponding attachable arrangement with a plate-like component part, in particular a device or housing wall, and an attachable plug-type connector, wherein the plug-in section of the attachable plug-type connector is plugged into an opening in the component part as far as the plug-in stop and is fixed from behind in this position with the aid of the latching means.

An advantage of the present invention is to specify an attachable plug-type connector which—even if already preassembled—can be easily and quickly mounted in an opening of a plate-like structure.

An advantage may be achieved according to the present invention by the features of claim 1. Advantageous embodiments of the invention are set forth in the dependent claims.

The invention is described in greater detail below with reference to an exemplary embodiment and the attached drawings.

FIG. 1 shows an attachable plug-type connector 10 with an attachable housing 12 and a contact carrier 14 arranged in the attachable housing 12. The attachable plug-type connector 10 is comprised of two sections 16, 18: a plug-in section 16 and a connection section 18. The contact carrier 14 includes multiple plug-in structures 20 in the plug-in section 16 of the attachable plug-type connector 10, into which male connectors (not shown) that are safe to the touch are arranged. In this configuration, the male contacts are arranged in a row and the attachable plug-type connector 10 includes a square "plug face" with these structures 20.

The male contacts serve to interconnect with corresponding female contacts of a plug connector-counterpart not shown here. Associated with each of the male contacts within the contact carrier 14 is a corresponding connection element (also not shown), each of the male contacts being electrically connected with its associated connection element. The connection elements are arranged within the connection section 18 of the attachable plug-type connector 10 that is attached to the plug-in section 16.

These contact elements are preferably in the form of crimp contact elements. The crimp contact elements are, for example, stamp-rolled or solid-turned in design, optionally with a silver or gold-coated surface for conductors of 0.14 to 35 $mm^2$, preferably for conductors of 0.14 to 16 $mm^2$.

The outer portion of the attachable housing 12 includes a circumferential rim 22 between the plug-in section 16 and the connection section 18 of the attachable plug-type connector 10, which rim defines a plug-in stop 24 of the attachable plug-type connector 10.

Figure 2:
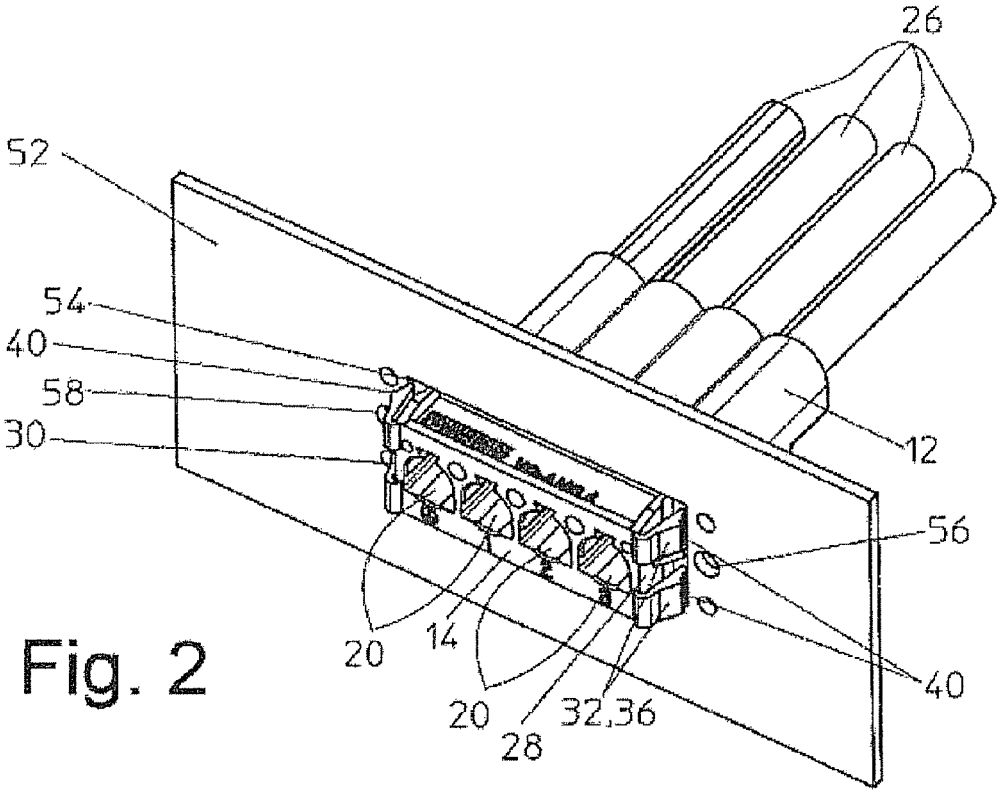

The attachable plug-type connector 10 shown in the FIGS. 1 and 2 is designed as an automatically preassembled attachable plug-type connector 10 and is already equipped with wires 26, that is, preassembled. The ends of these wires 26 are connected by crimp contacts to the contact elements of the attachable plug-type connector 10, the former being designed as crimp contact elements. The crimp contact elements are also arranged in a row in conformity with the serial arrangement of the male contacts.

The attachable plug-type connector 10 is —as previously stated—configured as an attachable plug-type connector with a square plug face. This square plug face has two short sides (the flanks) and two long sides. On each of the two opposite short sides the attachable housing 12 includes in the plug-in section 16 a latching means 28, 30, each with a spring device 32, 34. Each of the spring devices 32, 34 is a spring arm 26, 38 affixed to a housing body of the attachable housing 12, and each of the spring arms 32, 34 includes on its free end two latch surfaces 40.

The rim 22 is part of the attachable housing 12 and includes lateral extensions 42, 44, respectively behind the latching means 28, 30 as seen from the end edge of the plug-in section 16, wherein said extensions 42, 44 have end faces 46 aligned flush with one another. Each of the extensions 42, 44 also has a recess into each of which is pressed a press-in nut 48, 50. The press-in nuts 48, 50 shown in FIG. 1 are hexagonal nuts. Alternatively the press-in nuts 48, 50 can also be square nuts.

FIG. 2 shows an attachable arrangement of the attachable plug-type connector 10 of FIG. 1 on a plate-like component part 52. In this arrangement, the plug-in section 16 of the attachable plug-type connector 10 is plugged into an opening 54 present in the component part 52 in such a way that the plug-in stop 24 rests flush against the surface of the plate-like component part 52 that surrounds the opening 54. Once this position is reached, both latching means 28, 30 have passed completely through the opening 54 and have spread out as a result of the spring forces of the spring devices 32, 34 designed as spring arms 36, 38 in such a way that the latching surfaces 40 are braced against the other surface of the side of the plate-like component part 52 opposite the plug-in stop 24. The attachable plug-type connector 10 is thus positively fixed to the component part 52 by means of the latching means 28, 30 and the plug-in stop 24.

The plate-like component part 52 includes holes 56, 58 at the level of the internal threads of both press-in nuts 48, 50 in the extensions 42, 44 of the attachable housing 12. In this arrangement, each of the press-in nuts 48, 50 is a press-in nut for forming a releasable screw connection with a locating screw of a plug connector counterpart plugged onto the attachable plug-type connector 10, which locating screw extends through each hole 56, 58.

Each latching means 28, 30 is disposed in the plug-in section 16 between the housing body of the attachable housing 12 and the press-in nuts 48, 50 located further out in the extensions 42, 44. This results in the following function: The latching means 28, 30 of the attachable plug-type connector 10, because of their spring devices 32, 34, make it possible with the aid of said spring devices 32, 34 to automatically latch the attachable plug-type connector 10 into position from behind when it is plugged in on the plug-in section side in the opening 54 as far as the plug-in stop 24. Thus, it does not require elaborate motor skills to introduce and secure in place even an attachable plug-type connector 10 already equipped with wires 26 and therefore preassembled, in the opening 54 of the plate-like component part 52 designed as a device or housing wall.

Paired with the crimp contact elements, it is possible for the contact carrier 14 or the complete attachable plug-type connector 10 to first be preassembled and to be subsequently installed in a particularly simple manner with the aid of the latching means 28, 30. No intermediate steps are necessary with this installation. By designing the attachable plug-type connector 10 with the previously described latching means 28, 30 and the connection elements in the form of crimp contact elements, it is possible to reduce to a fraction (approximately a twentieth) the amount of time otherwise required to install the attachable plug-type connector.

LIST OF REFERENCE NUMERALS

Attachable plug-type connector 10
Attachable housing 12
Contact carrier 14
Plug-in section 16
Connection section 18
Plug structure 20
Rim 22
Plug-in stop 24
Wire 26
Latching means 28
Latching means 30
Spring device 32
Spring device 34
Spring arm 36
Spring arm 38
Latching surface 40
Extension 42
Extension 44
End face 46
Press-in nut 48
Press-in nut 50
Plate-like component part 52
Opening 54
Hole 56
Hole 58

The invention claimed is:

1. An attachable plug-type connector for attachment to a plate-like component part, with an attachable housing and a contact carrier arranged in the attachable housing, the attachable plug-type connector comprising:

a plug-in section and a connection section, wherein the attachable housing has at least one plug-in stop and at least one latching structure for affixing the attachable plug-type connector to an edge which delimits an opening of the plate-like component part, said attachable plug-type connector being latched behind said edge, wherein fixing of the attachable plug-type connector on the component part occurs automatically when the plug-in section is plugged into the opening as far as the plug-in stop via a spring device on the latching structure, and wherein the plug-in stop has a circumferential rim, the circumferential rim including extensions on opposite sides of the attachable housing, each of the extensions comprises an end face that is aligned flush with an associated surface area on the plate-like component part when the attachable plug-type connector is in a fixed position, wherein each of the extensions accommodates at least one press-in nut, and wherein the spring device includes a spring arm arranged on a housing body of the attachable housing, wherein a free end of the spring arm is directed towards the circumferential rim and a latching surface is formed at the free end.

2. The attachable plug-type connector according to claim 1, wherein the spring device is preloaded via the edge delimiting the opening when passing through the opening.

3. The attachable plug-type connector according to claim 1, wherein the latching structure comprises a portion that passes completely through the opening to achieve the fixed position of the attachable plug-type connector.

4. The attachable plug-type connector according to claim 1, further comprising at least one pair of latching structure arranged on opposite sides of the attachable housing.

5. The attachable plug-type connector according to claim 1, wherein the attachable housing is made of an electrically insulating material.

6. The attachable plug-type connector according to claim 1, wherein the attachable housing and the contact carrier are designed together as a single piece.

7. An attachable arrangement with a plate-like component part comprising a device or housing wall, and an attachable plug-type connector according to claim 1, wherein the attachable plug-type connector together with a corresponding plug-in section is inserted into an opening in the component part as far as the at least one plug-in stop and fixed in position from behind via the at least one latching structure.

8. The attachable plug-type connector according to claim 3, further comprising at least one pair of latching structure arranged on opposite sides of the attachable housing.

9. The attachable plug-type connector according to claim 3, wherein the attachable housing is made of an electrically insulating material.

10. The attachable plug-type connector according to claim 3, wherein the attachable housing and the contact carrier are designed together as a single piece.

11. The attachable plug-type connector according to claim 4, wherein the attachable housing is made of an electrically insulating material.

12. The attachable plug-type connector according to claim 4, wherein the attachable housing and the contact carrier are designed together as a single piece.

13. The attachable plug-type connector according to claim 4, wherein the spring device is preloaded via the edge delimiting the opening when passing through the opening.

14. The attachable plug-type connector according to claim 5, wherein the attachable housing and the contact carrier are designed together as a single piece.

15. The attachable plug-type connector according to claim 5, wherein the spring device is preloaded via the edge delimiting the opening when passing through the opening.

* * * * *